US006989491B2

(12) United States Patent
Triantopoulos et al.

(10) Patent No.: US 6,989,491 B2
(45) **Date of Patent: *Jan. 24, 2006**

(54) GROUND BUS BAR CONNECTOR

(75) Inventors: George Triantopoulos, Collierville, TN (US); Jerry Woodward, Collierville, TN (US)

(73) Assignee: Thomas & Betts International, Inc., Sparks, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/654,638

(22) Filed: Sep. 4, 2003

(65) Prior Publication Data

US 2004/0058571 A1 Mar. 25, 2004

Related U.S. Application Data

(63) Continuation of application No. 10/047,673, filed on Jan. 14, 2002, now Pat. No. 6,649,840.

(60) Provisional application No. 60/263,314, filed on Jan. 22, 2001.

(51) Int. Cl.
*H01R 4/18* (2006.01)

(52) U.S. Cl. ..... 174/84 C; 174/94 R

(58) Field of Classification Search ..... 174/84 C, 174/94 R; 439/877; 29/861, 863
See application file for complete search history.

(56) References Cited

U.S. PATENT DOCUMENTS 3,236,938 A 2/1966 Toedtman
3,340,352 A 9/1967 Teagno et al.
3,354,517 A 11/1967 Levinsky
3,546,366 A 12/1970 Taedtman et al.
3,781,459 A 12/1973 Peek
5,036,164 A 7/1991 Schrader et al.
5,103,068 A * 4/1992 Schrader ..... 174/94 R
5,200,576 A 4/1993 Schrader et al.
5,936,200 A * 8/1999 Park ..... 174/59
5,997,368 A 12/1999 Mello et al.
6,452,103 B1 9/2002 Piriz et al.
6,649,840 B2 * 11/2003 Triantopoulos et al. ... 174/84 C

FOREIGN PATENT DOCUMENTS

DE 1465138 A 1/1969

* cited by examiner

*Primary Examiner*—Chau N. Nguyen
(74) *Attorney, Agent, or Firm*—Hoffmann & Baron, LLP

(57) ABSTRACT

A ground connector for providing quick and secure connection between a plurality of electrical conductors and a ground bus bar. The connector has a generally U-Shaped body of deformable conductive material with a pair of outwardly directed shoulders and a pair of legs at opposite ends of the body, including an open ended slot for receiving a bus bar to establish an electrical crimp connection. Each leg includes teeth extending into the slot for engagement with the bus bar. The lower end of the slot has a pair of outwardly angled cut outs to allow the legs of the body to deform for a secure crimp connection to the bus bar. The body further includes a pair of apertures spaced at apart locations opposite the legs, respectively, for receiving conductors therein. Each of the apertures has access openings extending through the lower surface of the body to provide an area of relief upon deformation of the body around the conductors.

10 Claims, 6 Drawing Sheets

GROUND BUS BAR CONNECTOR

This application is a continuation of U.S. patent application Ser. No. 10/047,673 filed on Jan. 14, 2002 now U.S. Pat. No. 6,649,840, which is claims priority to the provisional application 60/263,314 filed on Jan. 22, 2001.

FIELD OF THE INVENTION

The present invention relates generally to a connector for attachment to a ground bus bar. More particularly, the present invention relates to a connector for providing quick and secure connection between a plurality of electrical conductors and a ground bus bar.

BACKGROUND OF THE INVENTION

It is well known to use compression connectors to effect connection between a bus bar and a plurality of electrical conductors. One example of such a bus bar connector is shown in U.S. Pat. No. 5,997,368 issued Dec. 9, 1999 entitled "CONNECTOR FOR CONNECTING A CONDUCTOR TO A STRUCTURAL MEMBER," the disclosure of which is incorporated by reference herein for all purposes.

One embodiment shown in the '368 patent includes a generally U-shaped connector where the bus bar is received in the space between the legs of the U-shaped body. At the upper end of the U-shaped legs, channels are formed for accommodating a ground conductor. The conductors are connected in the channels and the connector is attached to the bus bar. The connector is crimped in a subtle crimped tool to effect connection between the conductor and the bus bar.

While the conductor of the '368 patent serves adequately to connect the ground conductors to the bus bar, the ground connectors and the bus bar must be crimped to the connector simultaneously. Any attempt to crimp the conductors to the connector prior to crimping the connector to the bus bar will result in the shortage of space between the legs, which is to receive the bus bar, closing and preventing insertion thereinto.

It is, therefore, desirable to provide a connector which allows subsequent crimping of the connector to the bus bar after the crimping of the conductors to the connector.

SUMMARY OF THE INVENTION

The present invention discloses a ground connector, for providing a quick, secure and permanent connection between a plurality of conductors and a ground bus bar. The ground conductors are crimped first in the tool before the connector is slipped over the bus bar, thereby establishing electrical and mechanical connection there between.

In accordance with one embodiment of the present invention, there is provided a ground connector having a deformable generally U-Shaped conductive body including a pair of legs projecting from the body. The legs define an open ended slot for receiving a bus bar therein for crimp connection. A plurality of teeth on at least one of the legs project into the slot to establish an electrical connection between the bus bar and the body. Additionally, the body has at least one aperture to receive at least one conductor therein so that when the body is deformed to crimp the bus bar in the slot, the conductor is crimped within the aperture to the body.

In accordance with another embodiment of the present invention, there is provided a ground connector having a generally U-Shaped body of deformably conductive material including a pair of open ended slots. Each of the slots are defined by opposed, spaced sidewalls and a closed end, and are configured to receive a respective bus bar therein through the open end. A plurality of teeth extend on each of the side walls of the slots to establish an electrical crimp connection between the respective bus bars and the body. Additionally, the body includes a plurality of apertures extending through the body, where at least one of the apertures is located on opposite sides of at least one of the slots to respectively receive at least one conductor therein, so that when the body is deformed to crimp the bus bars in the slots, the conductors are crimped within the apertures to the body.

In accordance with further embodiment of the present invention, there is provided a ground connector having a conductive deformable body including a pair of legs at opposite ends of the body defining a generally U-shaped configuration. The body has an open ended slot defined by a lower end and opposed side walls extending upwardly from a center portion of the body on each leg, the slot being adapted to receive a bus bar for electrical crimp connection. A plurality of inwardly teeth extend from each of the side walls into the slot to establish an electrical crimp connection between the bus bar and the body. The body at the lower end of the open ended slot has a pair of spaced apart outwardly angled cut outs to allow the body to deform into a secure crimp connection to the bus bar. Additionally, a pair of spaced apertures, each of the aperture being adapted to receive at least one conductor therein, so that when the opposite ends of the body are deformed to crimp the bus bar, the conductors are crimped to the body.

In accordance with even further embodiment of the present invention, a method for crimping a connector to at least one bus bar and at least one conductor is provided. The method includes providing a connector including a deformable body having a pair of legs defining a central opening, where each leg has teeth extending into the opening, the body has at least one channel extending through, and the channel is adapted to receive a conductor therein; placing at least one conductor in the channel; deforming the body to initiate a partial crimp between the body and the conductor placed in the channel; inserting a bus bar into the central opening of the body after the conductor is partially crimped and continuing to deform the connector until the conductors are tightly crimped within the channels in the body and the bus bar is crimped between the legs.

DETAILED DESCRIPTION OF THE PREFERRED EMBODIMENT

Figure 1:
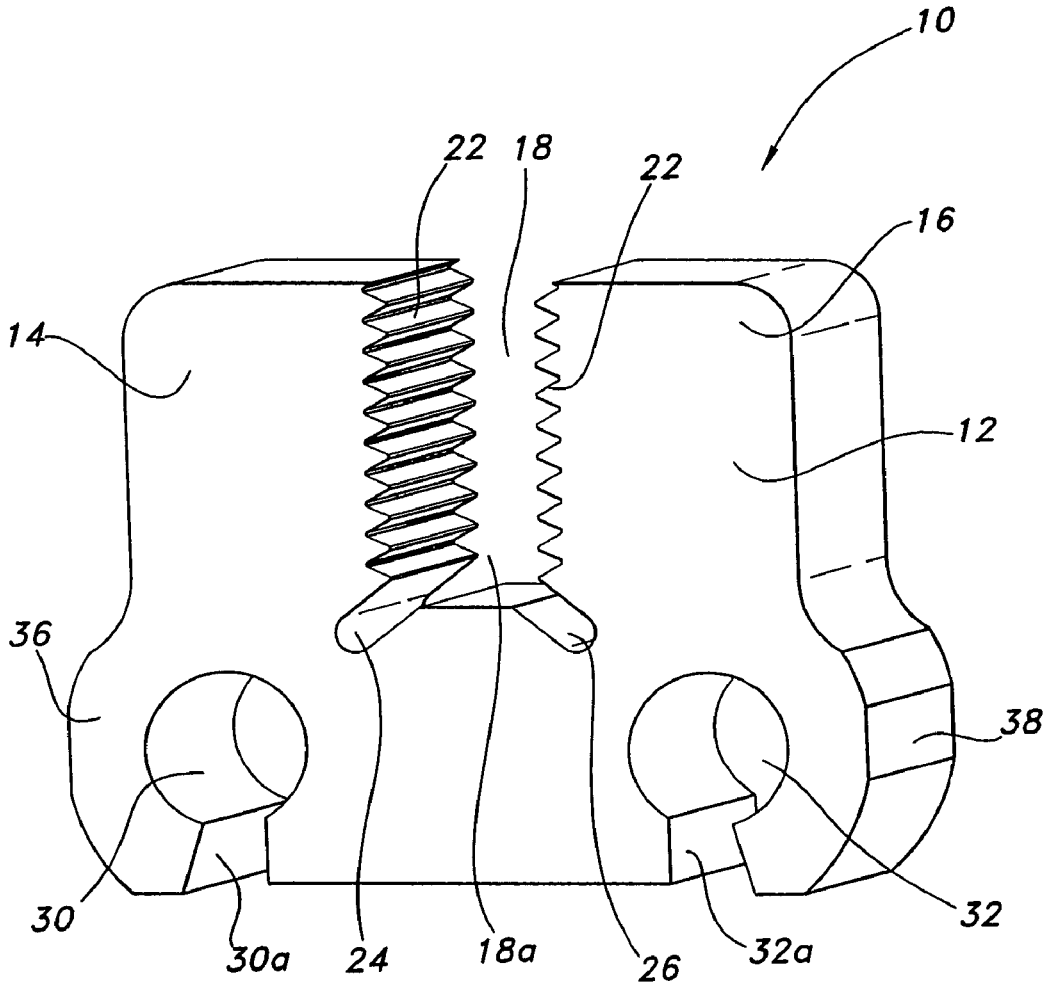
FIG. 1 is a perspective showing of one embodiment of the ground bus bar connector of the present invention.

Referring now to FIG. 1, an improved bus bar connector of the present invention is shown.

Bus bar connector 10 includes a generally flat planar body 12, formed of malleable electrical conducting metal, preferably copper. The body may be considered to be U-shaped, having a pair of legs 14 and 16 and a central upwardly extending, open ended slot 18. Slot 18 accommodates a rectangular bus bar (not shown) for electrical crimp connection thereto. In order to enhance the mechanical and electrical engagement between the bus bar and the body 10, the body includes a plurality of inwardly directed teeth 22, defining the perimeter of the slot 18. The teeth 22 help engage the bus bar by aggressively biting into the bus bar, penetrating any coating thereon to establish engagement therewith, increasing the electrical and mechanical performance. The slot 18 opens up in a scissors like fashion to allow for easy slippage over the bus bar, not shown, where the connector, 10 is fully crimped over the bus bar.

The lower end 18*a* of slot 18 further includes a pair of outwardly angled cut outs 24 and 26. The cut outs 24 and 26 are provided by way of relief to help deform the legs 14 and 16 of the body during crimping to provide secure crimp connection to the bus bar. Also, the cut outs 24 and 26 in the slot 18 reduce the force required to crimp the body 12 to its proper configuration while making the installation easier for the user.

Body 10 includes a pair of conductor receiving apertures or channels 30 and 32 spaced at apart locations opposite legs 12 and 14. Channels 30 and 32 are generally cylindrical so as to accommodate a cylindrical ground wire (not shown), freeing the installer's hand to operate the tool. Each channel 30 and 32 include an access openings 30*a* and 32*a* respectively in communication therewith, extending through the lower surface of the body. The access openings provide an area of relief which accommodates the crimp connection of the body around the conductors. Further, body 12 includes a pair of outwardly directed shoulders 36 and 38, which provide a wider dimension in body 12 at the lower end thereof.

A preferred embodiment of the bus bar connector of the present invention is shown in FIG. 1. Alternative embodiments of the bus bar connector is shown with respect to FIGS. 2 and 3, where like reference numerals denote like components.

Figure 2:
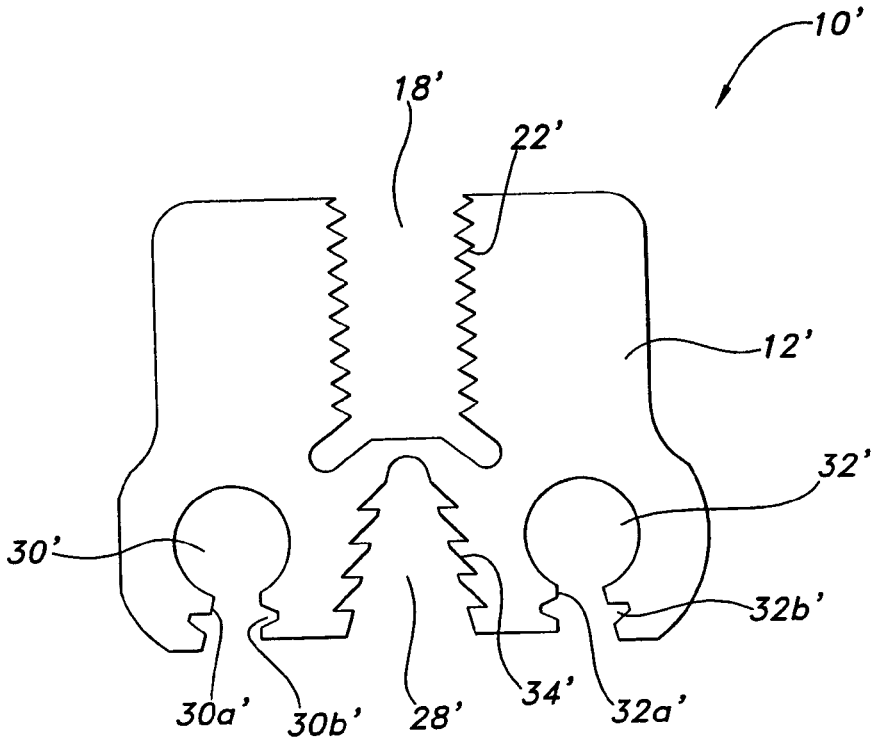
FIGS. 2 and 3 are alternate embodiments of the ground bus bar connector of the present invention.

Bus bar connector 10', shown in FIG. 2, is substantially similar to bus bar connector 10 of FIG. 1. Bus bar connector 10' includes a secondary slot 28' formed in body 12', extending inwardly from a lower surface thereof. Slot 28' may be used to accommodate, in an alternate fashion, a bus bar from the opposed lower end of body 12'. Slot 28' may include inwardly directed teeth 34' which are substantially similar to teeth 22' shown in upper slot 18'. The lower slot 28' also provides an area of relief to facilitate crimping of the connector.

Also, the conductor receiving apertures or channels 30' and 32' may include modifications to the access openings 30*a*' and 32*a*'. In this regard, the access openings may include inwardly facing recesses 30*b*' and 32*b*' which may additionally accommodate a smaller gauge ground conductor for crimp connection with connector 10'.

Figure 3:
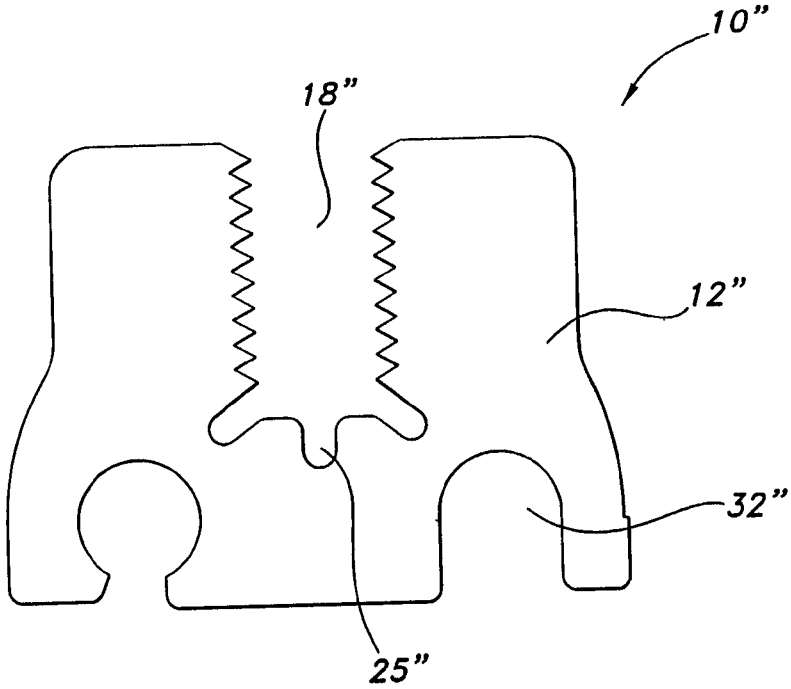

A further embodiment is shown in FIG. 3 where bus bar connector 10" is substantially similar to bus bar connector 10 of FIG. 1. The lower end of slot 18" includes a centrally located cut out 25" which also provides additional relief to help deform the legs of body 12" during crimping. It is additionally contemplated that an additional ground conductor may be inserted in cut out 25" for crimp connection to connector 10". Also shown in FIG. 3 is an alternate configuration for conductor receiving channel 32".

The alternate embodiments of the connector shown in FIGS. 2 and 3 provide a body having alternate grooves, slots, holes of any shape and size possible, to accommodate more than two ground conductors of various ranges, simultaneously.

FIGS. 4–7 show the progressive steps of crimping a pair of conductors to a bus bar, employing a bus bar connector of the present invention.

Figure 4:
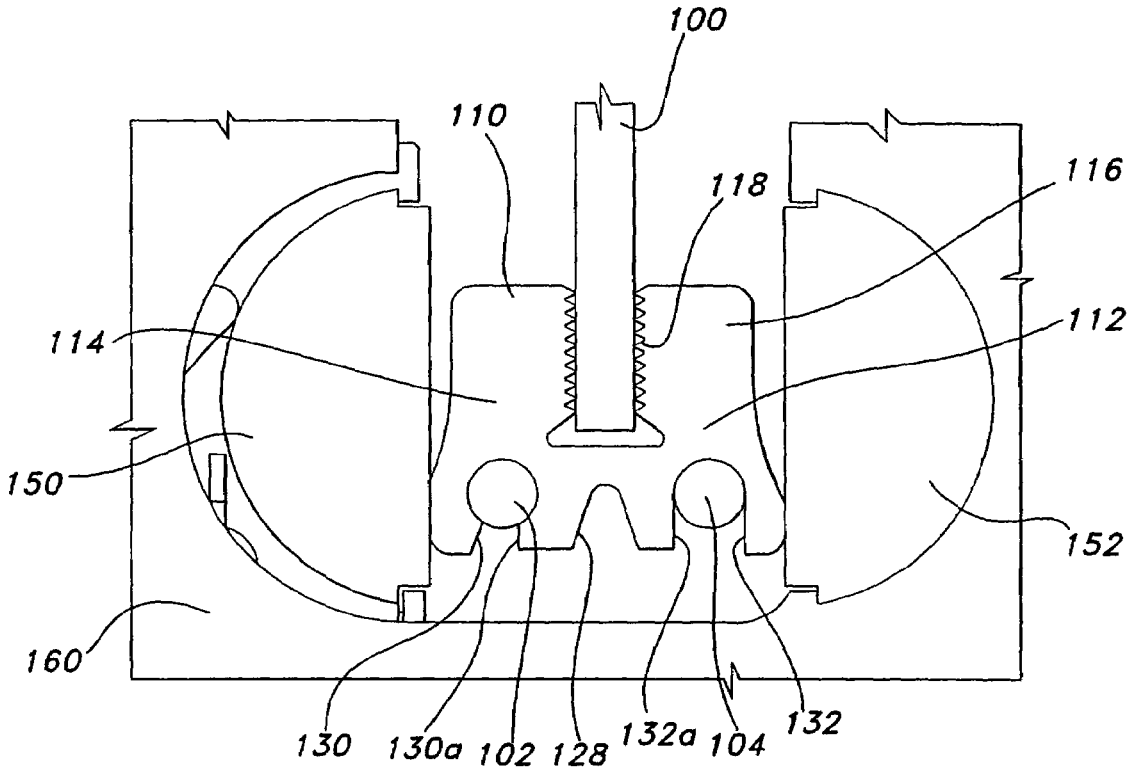
FIGS. 4–7 show the progressive steps of crimping a pair of conductors to a bus bar, employing a bus bar connector of the present invention.

Referring now to FIG. 4, is shown the connector 110 of the present invention. Connector 110 includes a connector body 112, having a pair of legs 114 and 116, separated by a central slot 118. Bus bar 100 is shown inserted in the slot 118. The body includes a pair of channels 130 and 132 for accommodating conductors 102 and 104. The channels are accessible through access openings 130*a* and 132*a*. Also provided in the embodiment shown in FIG. 4, is a lower slot 128 between channels 130 and 132. The lower slot 128 extends inwardly from a lower surface thereof. The connector body 112 may be positioned between a pair of spaced apart dies 150 and 152 of a crimping tool 160. When so positioned, the conductors 102 and 104 may be inserted into channels 130 and 132. While bus bar 100 is shown positioned within slot 118, at this stage of crimping it need not be positioned therein.

Figure 5:
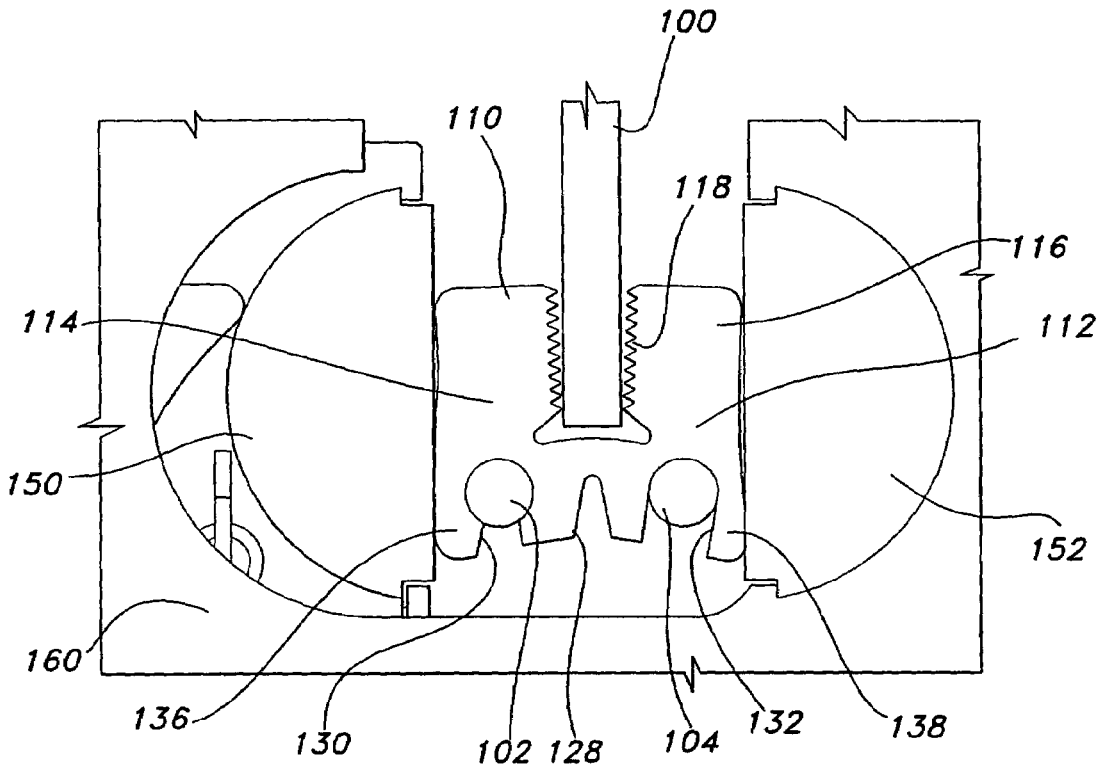

Referring now to FIG. 5, is shown the beginning of the crimping process. Dies 150 and 152 are shown to have partially moved toward each opposite end of the connector 110. This partial movement of the dies causes the connector 110 to deform by engagement of the dies 150 and 152 by the shoulders 136 and 138 thereof. This partial movement begins the crimping process which partially crimps the conductors 102 and 104 therein. Slot 118 slightly opens during the initial crimping process, allowing the bus bar 100 to be subsequently placed therein.

Figure 6:
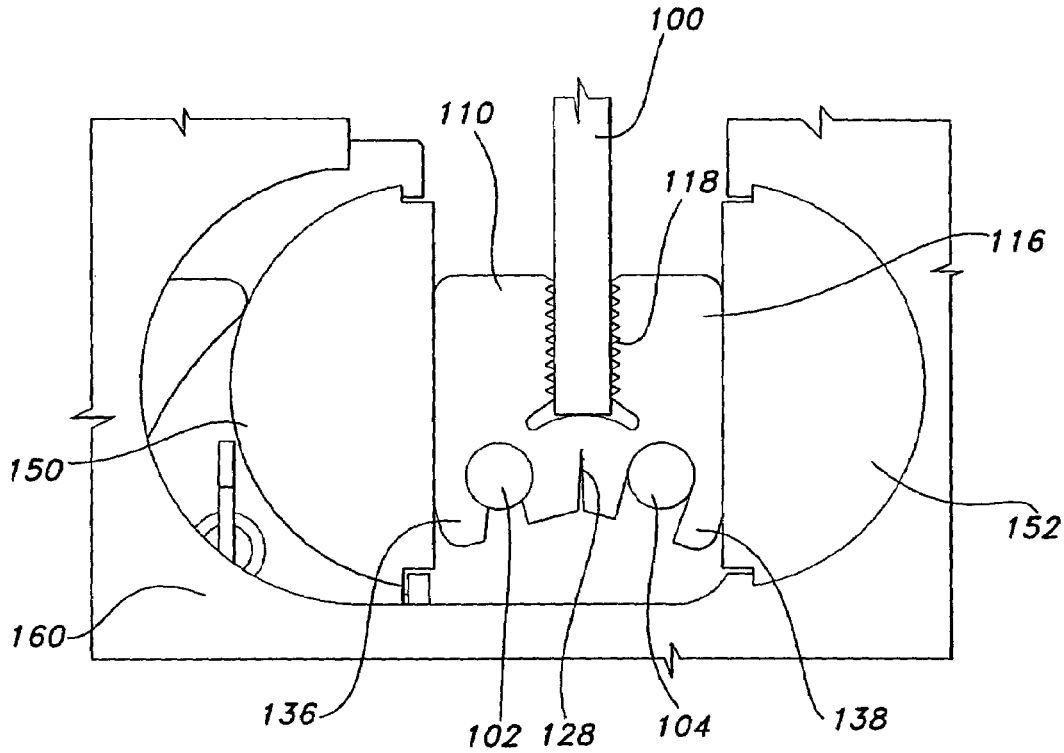

FIG. 6 shows continued crimping of connector 110 by movement of dies 150 and 152. Continued crimping flattens the shoulders 136 and 138, causing the remainder of connector 110 to be deformed. Such deformation slightly crimps the conductors 102 and 104 in the connector while crimping the bus bar between the legs 114 and 116. The lower slot 128, provided for relief, substantially closes under such crimping.

Figure 7:
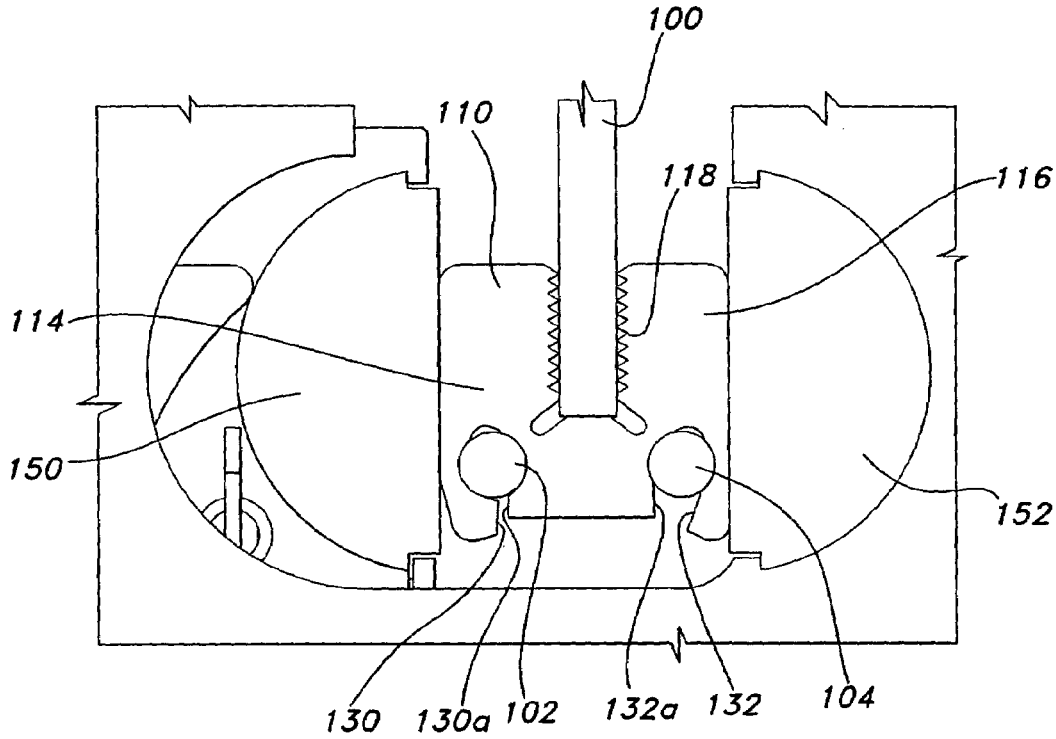

FIG. 7 shows the fully crimped connector 110 where the conductors 102 and 104 are tightly crimped within channels 130 and 132. The slots 130*a* and 132*a* have almost completely closed, providing a tight crimped connection with connector body 112. Also, the legs 114 and 116 are crimp connected to the bus bar 100, at slot 118, providing electrical and mechanical engagement there between. The location and arrangement of the conductor receiving channels 130 and 132 as well as the slot 118 allows for ease of installation and crimping. As noted, the conductors 102 and 104 can be initially partially crimped in connector 110 prior to insertion of bus bar 100. This allows the installer to position the conductors 102 and 104 in the connector 110 in a partial crimped fashion, freeing the installer's hands to insert bus bar 100.

While the invention has been described by the foregoing detailed description in relation to the preferred embodiments, it will be understood by those skilled in the art that various changes may be made without deviating from the spirit and scope of the invention.

What is claimed is:

1. A ground connector capable of being crimped, comprising:

a deformable generally U-Shaped conductive body comprising a pair of legs projecting from said body, said legs defining a central slot configured for receiving a bus bar therein;

a plurality of teeth on at least one of said legs projecting into said slot to establish an electrical connection between the bus bar and the body; and at least one aperture to receive at least one conductor therein so that when said body is deformed to initiate a partial crimp between said body and the conductor within said aperture, said central slot is slightly opened to receive the bus bar therein; and a pair of outwardly angled cut outs at a closed end of said slot to allow the body to deform into a secure crimp connection to the bus bar.

2. The ground connector of claim 1 wherein said at least one aperture includes access openings extending through a lower surface of the body, to thereby permit deformation of the body at said aperture and a secure crimp connection of the body around said conductor.

3. The ground connector of claim 1 wherein said aperture comprises sections of different shapes and sizes to accommodate said conductors of various ranges.

4. A ground connector capable of being crimped, comprising:

a generally U-Shaped body of deformably conductive material having a pair of open ended slots, each of said slot being defined by opposed, spaced sidewalls and a closed end; wherein one of said slots being configured to receive a respective bus bar therein and other of said slot being configured to provide an area of relief to facilitate said crimping of the connector;

a plurality of teeth extending on each of said side walls of said slots to establish electrical crimp connection between the respective bus bars and the body; and a plurality of apertures extending through said body, wherein at least one of said apertures being on opposite side of at least one of said slots to respectively receive at least one conductor therein so that when said body is deformed to initiate a partial crimp between the body and the conductor within said at least one aperture, only one of said open ended slots is slightly opened to receive the respective bus bar therein.

5. The ground connector of claim 4 wherein at least one of said slots has a pair of outwardly angled cut outs to allow deformation of the body for crimp connection to the bus bars.

6. The ground connector of claim 4 wherein said at least one aperture includes an access opening to permit deformation of the body at said at least one aperture for crimp connection to at least one said conductor.

7. A method for crimping a connector to at least one bus bar and at least one conductor, comprising the steps of:

providing a connector including a deformable body comprising a pair of legs defining a central slot, each leg having teeth extending into the slot, said body having a pair of outwardly angled cut outs at a closed end of the slot, said cut outs allowing the body to deform into a secure crimp connection to a bus bar, and said body having at least one channel extending through said body, the channel being adapted to receive a conductor therein;

placing at least one conductor in the channel;

deforming the body to initiate a partial crimp between the body and the conductor placed in said channel thereby causing said central slot to be slightly opened;

inserting the bus bar into said slightly opened central slot of the body after the conductor is partially crimped;

continuing to deform the conductor until the conductor is tightly crimped within the channel in the body and said bus bar is crimped between the legs.

8. The method of claim 7, wherein the crimp connection is initiated by a crimping tool.

9. The method of claim 8, wherein the crimping tool includes a pair of spaced apart dies.

10. The method of claim 9, further including the steps of:

placing the body of the connector between the pair of spaced apart dies; and moving the dies towards opposite ends of the body to deform the connector therebetween.

* * * * *